US006378790B1

(12) United States Patent
Paterson et al.

(10) Patent No.: US 6,378,790 B1
(45) Date of Patent: Apr. 30, 2002

(54) SHOWER HEAD HAVING A RUBBER/ PLASTIC FACE PLATE AND A DIVERTER VALVE USING RUBBER SLEEVE BACK PRESSURE ACTIVATION

(75) Inventors: Graham H. Paterson, Wilmington; Willard A. Denham, Greenville, both of DE (US)

(73) Assignee: Speakman Company, Wilmington, DE (US)

( * ) Notice: Subject to any disclaimer, the term of this patent is extended or adjusted under 35 U.S.C. 154(b) by 0 days.

(21) Appl. No.: 09/491,393

(22) Filed: Jan. 26, 2000

(51) Int. Cl.[7] ..... B05B 1/32

(52) U.S. Cl. ..... 239/456; 239/437; 239/449; 239/554; 137/853

(58) Field of Search ..... 239/437–449, 239/391, 393, 436, 456, 460, 554, 555, 563, 570, 571, 107, 114, 123, 138; 137/853

(56) References Cited

U.S. PATENT DOCUMENTS

| | | | | |
|---|---|---|---|---|
| 2,968,443 A | | 1/1961 | Manning | |
| 3,004,719 A | | 10/1961 | Pouppirt, Jr. | |
| 3,013,729 A | | 12/1961 | McLean | |
| 3,065,917 A | | 11/1962 | Fraser | |
| 3,083,944 A | | 4/1963 | Doeden | |
| 3,373,942 A | | 3/1968 | Roman et al. | |
| 3,563,469 A | * | 2/1971 | Stacey | 239/460 |
| 3,963,179 A | | 6/1976 | Tomaro | |
| 3,967,783 A | | 7/1976 | Halsted et al. | |
| 4,117,979 A | | 10/1978 | Lagarelli et al. | |
| 4,688,276 A | | 8/1987 | Allison et al. | |
| 4,796,815 A | | 1/1989 | Greenberg | |
| 5,132,182 A | | 7/1992 | Grosse-Puppendahl et al. | |
| 5,246,169 A | | 9/1993 | Heimann et al. | |
| 5,265,415 A | * | 11/1993 | Cox, Jr. | 137/853 |
| 5,476,225 A | | 12/1995 | Chan | |
| 5,730,363 A | * | 3/1998 | Kress | 239/447 |
| 5,777,033 A | | 7/1998 | Venkataswamy et al. | |
| 5,918,811 A | | 7/1999 | Denham et al. | |
| 5,961,051 A | * | 10/1999 | Matsui | 239/570 |

* cited by examiner

*Primary Examiner*—David A. Scherbel
*Assistant Examiner*—Dinh Q. Nguyen
(74) *Attorney, Agent, or Firm*—Connolly Bove Lodge & Hutz LLP

(57) ABSTRACT

A shower head comprising a hollow body connected at one end to a water source, and a face, plate connected at the other end of the hollow body. The face plate includes a plastic substrate having a plurality of circumferential openings and a central opening provided therein. The face plate further has a thermoplastic rubber layer formed on portions of the plastic substrate, including the walls of the plastic substrate circumferential openings. The thermoplastic rubber layer formed on the walls of the plastic substrate circumferential openings includes ridge portions extending away from and circumferentially around the plastic substrate circumferential openings. The shower head further comprises a plurality of plungers connected to a spider, wherein each plastic substrate circumferential opening receives a corresponding plunger and the ridge portions closely surround the plungers. The shower head also comprises a diverter valve having a cylindrical insert communicating with the central opening of the face plate. The cylindrical insert has a plurality of openings formed therein and connects to the spider. The diverter valve has a deformable member arranged on the inside of the cylindrical insert and covers the plurality of openings formed in the insert. When water flowing through plungers is stopped, the water pressure against the deformable member increases and forces the deformable member away from the cylindrical insert openings, allowing water to flow through the central opening of the face plate.

28 Claims, 3 Drawing Sheets

SHOWER HEAD HAVING A RUBBER/ PLASTIC FACE PLATE AND A DIVERTER VALVE USING RUBBER SLEEVE BACK PRESSURE ACTIVATION

BACKGROUND OF THE INVENTION

A. Field of the Invention

The present invention relates generally to shower heads, and, more particularly to a shower head having a rubber/ plastic face plate that provides improved shower spray, and a diverter valve using rubber sleeve back-pressure activation.

B. Description of the Related Art

As shown in FIG. 1, a conventional shower head comprises a hollow body or shell 10 connected at its upper end to a source of water. Water discharges into a central body portion 12 of the shower head. A face plate 14 fits across the open bell end of body portion 10 and is held in watertight engagement therewith by means of an O-ring 16. Face plate 14 is held in position by means of a screw bolt 18 that is received in and held by a lower threaded portion of a sleeve 20. A tubular element 22 has a spider 24 integrally formed on a lower end thereof, and mounts around the outer circumference of sleeve 20. Spider 24 has a plurality of open slots formed therein. Directly below each slot is a corresponding opening 26 formed in face plate 14. Plungers 28 are engaged within in slots in spider 24, and protrude through openings 26 in face plate 14. Tubular element 22 is adjustable on sleeve 20 by means of a shaft 30 having an eccentric pin 32 on an end thereof. Pin 32 is received in and holds tubular element 22 and spider 24 together in a spaced relationship to face plate 14. A handle 34 connects to and rotates shaft 30, adjusting the relationship between face plate 14 and spider 24 and modifying the spray from the shower head.

As shown in FIG. 2, each plunger 28 comprises a body portion 36 having a plurality of grooves 38 in its sides and a shaft portion 40. Plungers 28 are provided in openings 26 of face plate 14. Shaft portion 40 attaches to spider 24 so that the location of plungers 28 may be adjusted with respect to openings 26 in face plate 14. Conventional face plates are made from brass, solid plastic, or solid plastic having a decorative face. Attaining a desirable spray pattern for the shower head requires a close fit between the periphery of plungers 28 and openings 26 in face plate 14. Thus, conventional face plate openings 26 need to be machined to precise dimensions, or, if plastic, molded to very close tolerances. Unfortunately, such machining is costly, time consuming, and inaccurate. Even precision molding is not always accurate enough, and is usually expensive.

One proposed solution to this problem is shown in U.S. Pat. No. 3,967,783 to Halsted et al. which discloses a shower head having an O-ring 73 located about the openings in the face plate, as shown in FIG. 1A. Spray nozzles 22, 23, however, have triangular grooves 31 formed along their entire lengths. Thus, O-ring 73 prevents leakage of water past spray nozzles 22, 23, except through triangular grooves 31. The shower head of Halsted et al., however, fails to provide a desirable spray pattern since the O-ring 73 does not provide a close, uniform fit between the periphery of spray nozzles 22, 23 and the face plate opening.

Some conventional shower heads incorporate a pulsating outlet and a diverter valve for activating the pulsating outlet. For example, the shower head of Halsted et al. comprises three spray exit openings, two for normal spray patterns and a third for pulsating spray patterns. Incoming pressurized water is fed into a diverter which includes a slide valve that adjustably proportions the flow of water into two flow paths. The first flow path from the slide valve terminates in the two normal spray exit openings, while water flowing along the second flow path drives a turbine and exits via openings in the pulsating outlet. The rotating turbine includes a mask which sequentially covers and uncovers the spray outlet to provide a pulsating outlet. A problem with conventional pulsating shower heads, such as the one shown in Halsted et al., is that the pulsating outlet and diverter valve require mechanically complex designs which are difficult to manufacture and maintain.

SUMMARY OF THE INVENTION

An object of the invention is to provide a shower head having an improved shower spray pattern and which overcomes the problems of related art shower heads.

It is another object of the present invention to provide a shower head face plate that provides a tight, uniform fit around the periphery of the plungers and overcomes the disadvantages of the related art.

A further object of the present invention is to provide a shower head face plate that is easy and inexpensive to manufacture and maintain, while maintaining very tight dimensional tolerances.

A still further object of the present invention is to provide a diverter mechanism for a shower head that is simple in design, and easy and inexpensive to manufacture and maintain.

Another object of the present invention includes eliminating the need for an O-ring seal between a shower head housing and face plate.

Still another object of the present invention is to improve and simplify the assembly of the face plate into the shower head.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a shower head having: a hollow body connected at one end to a water source; a face plate connected at the other end of the hollow body, the face plate including a plastic substrate having a plurality of openings formed therein and a thermoplastic rubber layer formed on portions of the plastic substrate, including walls of plastic substrate openings, wherein the thermoplastic rubber layer includes ridge portions extending away from and circumferentially around the plastic substrate openings; and a plurality of plungers, wherein each plastic substrate opening receives a corresponding plunger and the ridge portions closely surrounding the plungers to form a close fit between the plungers and plastic substrate openings.

To further achieve the objects, the present invention comprises a diverter valve for a shower head having a hollow body with a face plate at one end thereof, a water source at the other end thereof, and plurality of plungers connected to a spider, the face plate having a plurality of circumferential openings provided therein and a central opening provided therein, wherein each face plate circumferential opening receives a corresponding plunger, the diverter valve comprising: a cylindrical insert communicating with the cental opening of the face plate, the cylindrical insert having a plurality of openings formed therein and connecting to the spider; and a deformable member arranged on the inside of the cylindrical insert and covering the plurality of openings formed in the insert, wherein when water flowing through plungers is stopped, the water pressure against the deformable member increases and forces the sleeve away from the cylindrical insert openings, allowing water to flow through the central opening of the face plate.

To still further achieve the objects, the present invention comprises a plunger for a shower head having a hollow body with a face plate at one end thereof with an opening therein, a water source at the other end thereof, the plunger being variably positioned in the face plate opening and comprising: a generally cylindrical shaft portion having an upper end, means for attaching the shaft portion to a means for adjusting the plunger within the opening, and a lower end having a collar thereon whose diameter corresponds to that of the upper end; and a body portion having a plurality of semicircular grooves provided therein to permit water to pass through the opening in a controlled spray pattern, the plurality of semicircular grooves extending partially along the length of the body portion, the body portion further having a plurality of slots provided therein, each slot extending from a corresponding semicircular groove to a bottom of the body portion, wherein the slots permit water to pass through the opening in a needle-like spray pattern.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 5:
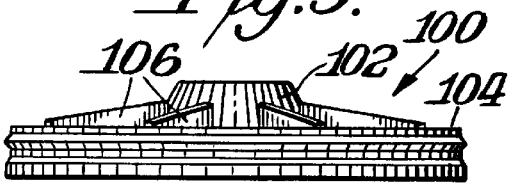
FIG. 5 is a side elevational view of a face plate in accordance with a preferred embodiment of the present invention.

In accordance with a preferred embodiment of the invention and as shown in FIG. 5, the present invention is drawn generally to a face plate 100 for a shower head utilizing plungers. Face plate 100 may be used with any shower spray apparatus having plungers and a hollow body connected at one end to a water source, for example, the Anystream® line of shower heads manufactured by the assignee of the present invention, Speakman Company. An example of an Anystream® shower head is shown in U.S. Pat. No. 3,373,942, assigned to Speakman Company and herein incorporated by reference.

Figure 1:
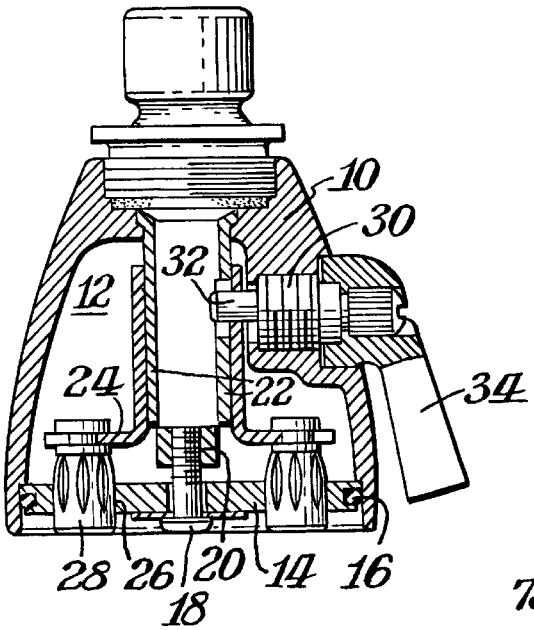
Fig. 1 (Prior Art)
FIG. 1 is a cross-sectional view showing a conventional shower.
Figure 1A:
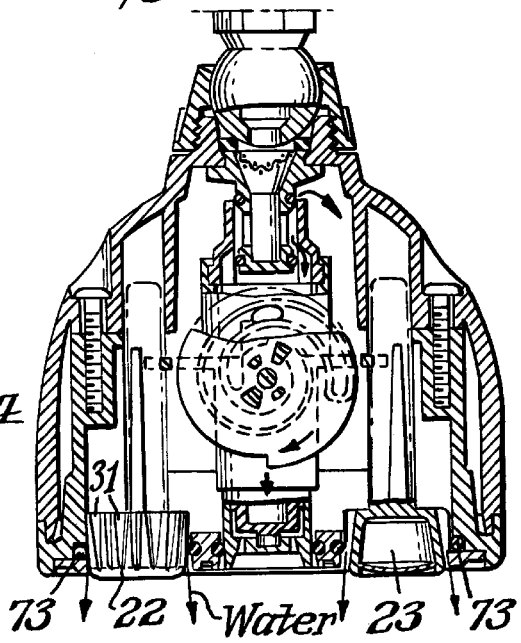
Fig. 1A (Prior Art)
FIG. 1A is a cross-sectional view of a conventional pulsating shower head having a plunger and face plate arrangement.
Figure 2:
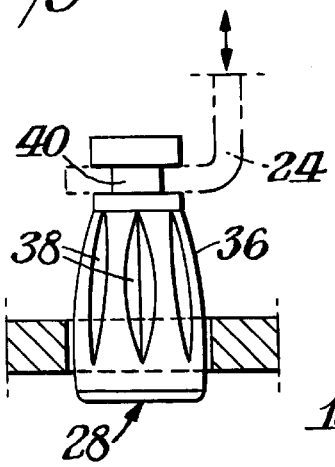
Fig. 2 (Prior Art)
FIG. 2 is an enlarged fragmental side elevational view of a plunger and the face plate of the conventional shower head shown in FIG. 1.
Figure 6:
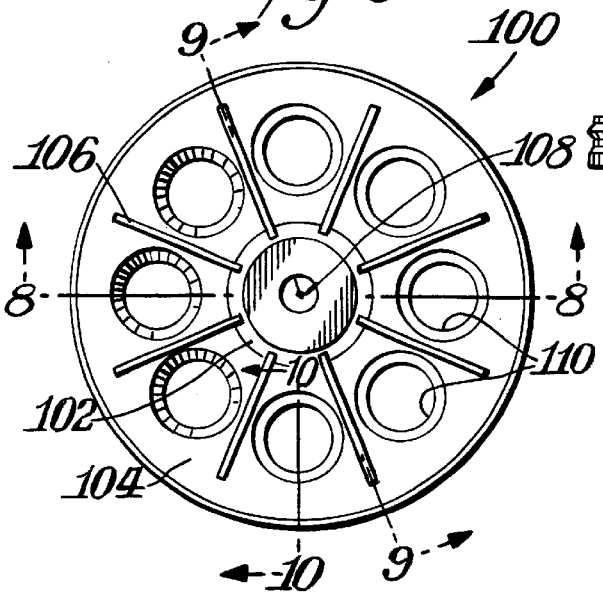
FIG. 6 is a top plan view of the face plate shown in FIG. 5.

Face plate 100 preferably is circular in shape (as best shown in FIG. 6) and has a hub portion 102 at its center and a wheel portion 104 extending away from hub portion 102. As can best be seen in FIG. 5, hub portion 102 extends above the top surface of wheel portion 104 such that a plurality of ribs or spokes 106 extend from hub portion 102 to the top surface of wheel portion 104, providing support thereto. Hub portion 102 has a central opening 108 so that a screw may be inserted therethrough to connect face plate 100 to a shower head body in a conventional manner (see, for example, FIG. 1). Wheel portion 104 has a plurality of openings 110 arranged circumferentially around hub portion 102. Each opening 1 10 accommodates a respective plunger of the shower head of the present invention, as discussed below.

Figure 11:
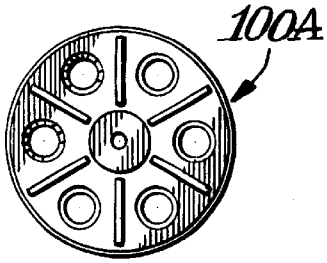
FIG. 11 is a reduced top plan view of a face plate in accordance with another preferred embodiment of the present invention.

The number and placement of the openings provided in the face plate of the present invention may vary. For example, the face plate may have two, three, four, six (as shown in FIG. 11) or eight (as shown in FIGS. 5–10) openings provided therein.

Figure 8:
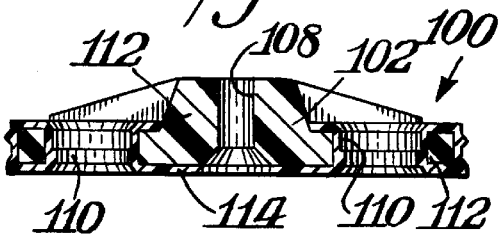
FIG. 8 is an elevational view of the face plate taken along line 8—8 of FIG. 6.
Figure 9:
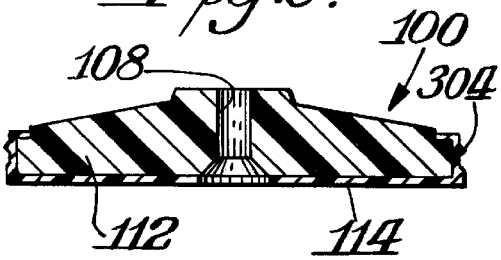
FIG. 9 is an elevational view of the face plate taken along line 9—9 of FIG. 6.

As shown in FIGS. 8 and 9, hub portion 102 and wheel portion 104 of face plate 100 preferably comprise a substrate 112 having a thermoplastic rubber layer 114 formed on portions thereof, Substrate may be made from a polypropylene plastic, and preferably is made from 15% to 20% glass-filled polypropylene plastic. Other materials usable in making substrate 1 12 of face plate 100 are nylon six or similar nylon polyamides, brass, stainless steel, and copper. Thermoplastic rubber layer 114 is formed from a dynamically vulcanized blend of polypropylene and EDPM rubber, commercially available under the trademark Santoprene® from Monsanto Company (St. Louis, Mo.). Rubber layer 114 is formed on portions of substrate 112 by contacting it with substrate 112, in the presence of a temperature and pressure system, thereby achieving firm chemical bonding between substrate 112 and thermoplastic rubber layer 114.

Face plate 100 of the present invention can be prepared by, although it is not limited to, the following process. In the process, plastic substrate 112, molded in the shape of a face plate for a plunger-type shower head, is prepared by compression molding, injection molding or extrusion. Plastic substrate 112 is then coated with a preformed thermoplastic rubber composition and subjected to specified temperature and pressure conditions. The coating of plastic substrate 112 with thermoplastic rubber layer 114 can be effected by compression molding, injection molding or extrusion.

The optimum process conditions depend upon the rubber mixture selected, and, in particular, on the chemical bond of the rubber mixture. For example, when Santoprene® rubber is used for thermoplastic rubber layer 114, suitable mold temperatures are between 370° C. and 400° C., and preferably between 380° C. and 390° C. The chemical bond time for the Santoprene® rubber is between two and three seconds, and preferably between four and eight seconds. In the case of coating and vulcanizing by a two-step extrusion process, plastic substrate 112 is covered with the thermoplastic rubber composition and bonded, if necessary, under pressure.

Figure 7:
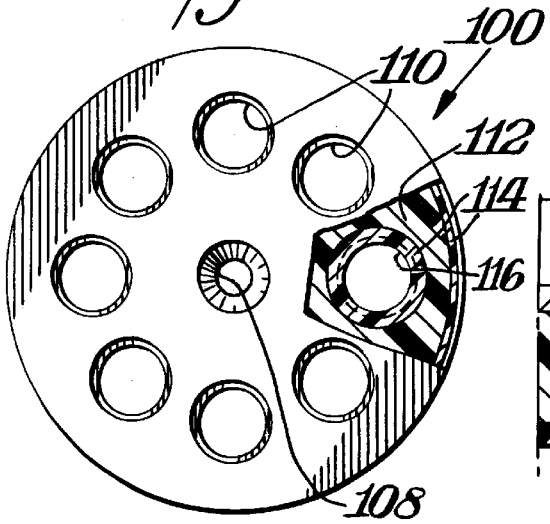
FIG. 7 is a bottom plan view of the face plate shown in FIGS. 5 and 6, partially broken away to reveal the thermoplastic rubber coating on the face plate.
Figure 10:
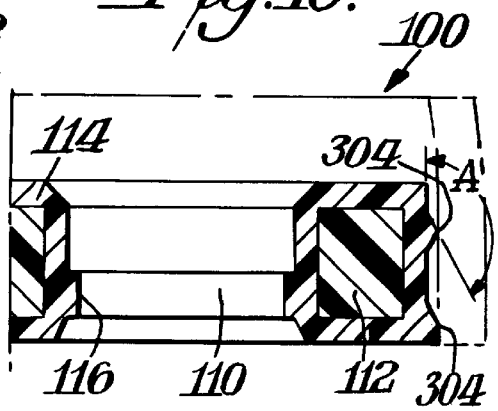
FIG. 10 is an enlarged cross-sectional view of the face plate taken along line 10—10 of FIG. 6.

As best shown in FIGS. 7 and 10, thermoplastic rubber layer 114 is formed on the walls of openings 110 formed in wheel portion 104. The thermoplastic rubber formed on the walls of openings 110 includes a ridge 116 extending away from and circumferentially around the walls of openings 110. Face plate 100 of the present invention provides a close or interference fit between the plungers, plunger grooves, and openings 110 due to the slight compression of ridge 116 of thermoplastic rubber layer 114 around the plungers. This eliminates the need for costly, time consuming, and inaccurate machining or precision molding of face plate openings 110, and provides an improved spray pattern for the water exiting the shower head via openings 110. Other advantages of rubber layer 114 of face plate 100 of the present invention include, but are not limited to, providing customized colors and markings for shower head face plates, providing a shower head with a soft-touch feel, and providing easily cleaned plungers due to the wiping action of the plungers against the ridges 116 of the thermoplastic rubber layer. Ridge 116 is designed to reduce friction with the plungers, provide a better spray pattern of water exiting from the shower head, and provide better cleaning of the plungers due to the wiping action between the plungers and ridge 116.

Figure 3:
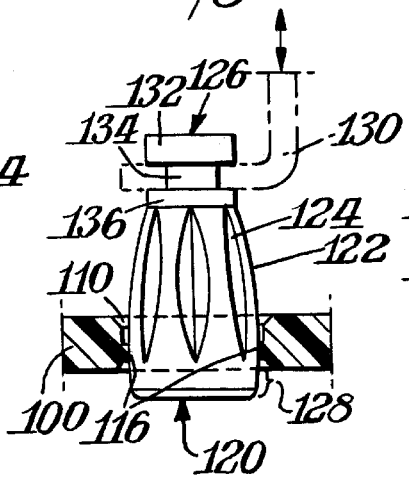
FIG. 3 is an enlarged fragmental side elevational view of a plunger and a face plate of a shower head in accordance with a preferred embodiment of the present invention.

Two types of plungers 120, 140 may be used with the shower head and face plate of the present invention. A first type of plunger 120, as shown in FIG. 3, comprises a body portion 122 and a cylindrical shaft portion 126. Cylindrical shaft portion 126 has an upper end 132, a central section 134 for attaching shaft portion 126 to a means for adjusting plunger 120 within opening 110, such as a spider 130, and a lower end 136 whose diameter corresponds to that of upper end 132. Preferably the means for adjusting the plunger comprises a spider 130 (partially shown in FIG. 3). Body portion 122 has varying diameters along its length, and a plurality of semicircular grooves 124 provided therein to permit water to pass through opening 110 in a controlled spray pattern. The plurality of semicircular grooves 124 extend partially along the length of body portion 122, ending at a bottom section 128 of body portion 122. Plunger 120 is variably positioned in face plate opening 110 so that the water spray pattern may be varied as the varying diameters of body portion 122 pass through opening 110. The flow of water may be stopped with plunger 120 if bottom section 128 of plunger 120 engages thermoplastic rubber ridge 116 provided in opening 110.

Figure 4:
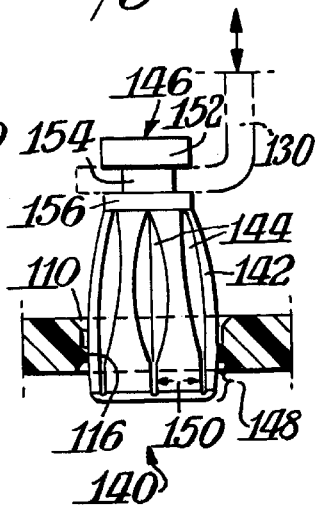
FIG. 4 is an enlarged fragmental side elevational view of a plunger and a face plate of a shower head in accordance with another preferred embodiment of the present invention.

A second type of plunger 140, as shown in FIG. 4, comprises a body portion 142 and a cylindrical shaft portion 146. Cylindrical shaft portion 146 has an upper end 152, a central section 154 for attaching shaft portion 146 to a means for adjusting plunger 140 within opening 110, and a lower end 156 whose diameter corresponds to that of upper end 152. Preferably the means for adjusting the plunger comprises a spider 130 partially shown in FIG. 4). Body portion 142 has varying diameters along its length, and a plurality of semicircular grooves 144 provided therein to permit water to pass through opening 110 in a controlled spray pattern. The plurality of semicircular grooves 144 extend partially along the length of body portion 142, ending at a bottom section 148 of body portion 142. Body portion 142 further has a plurality of slots 150 provided therein, each slot 150 extending from a corresponding semicircular groove 144 through bottom section 148 of body portion 142. Slots 150 permit water to pass through opening 110 in a needle-like spray pattern. Plunger 140 is variably positioned in face plate opening 110 so that the water spray pattern may be varied as the varying diameters of body portion 142 pass through opening 110. The flow of water may not be stopped with plunger 140 since slots 150 permit water flow even if bottom section 148 of plunger 140 engages thermoplastic rubber ridge 116 provided in opening 110.

Preferably plungers 120, 140 are molded from a thermoplastic polycarbonate since this material is non-corrosive. Other materials that could be used for plungers 120, 140 include, for example, phenoxy resins, polyphenylene oxide, and other similar materials.

Figure 12:
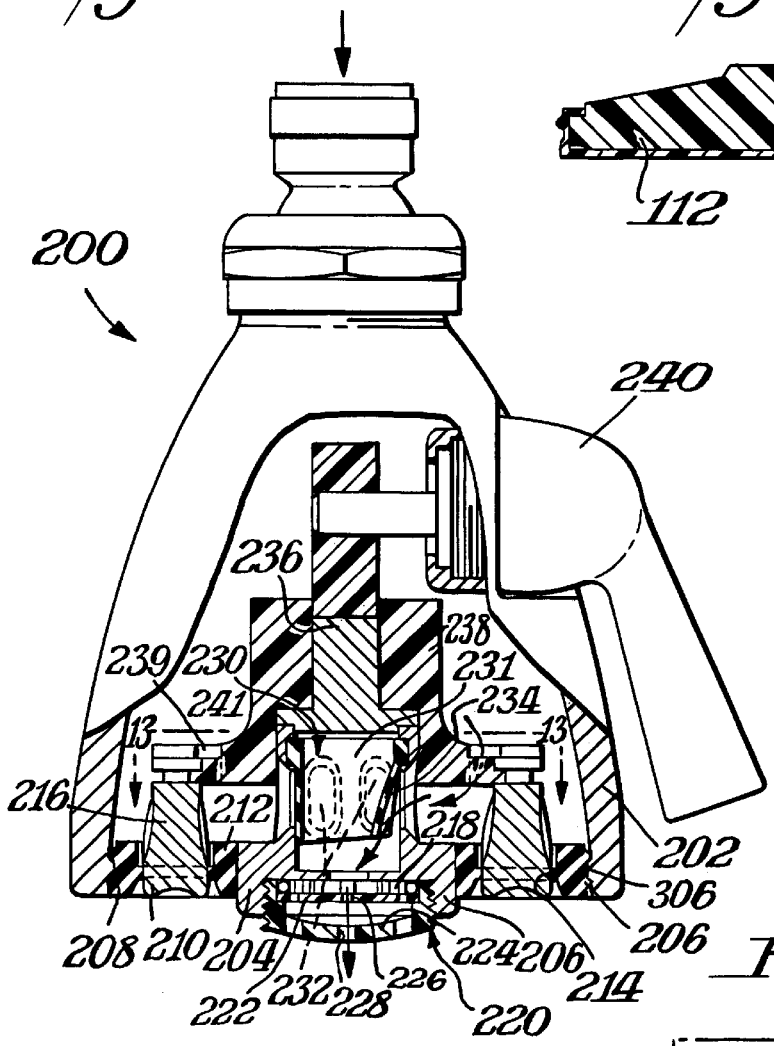
FIG. 12 is side elevational view of a pulsating shower head partially broken away to show a diverter valve in accordance with still another preferred embodiment of the present invention.
Figure 13:
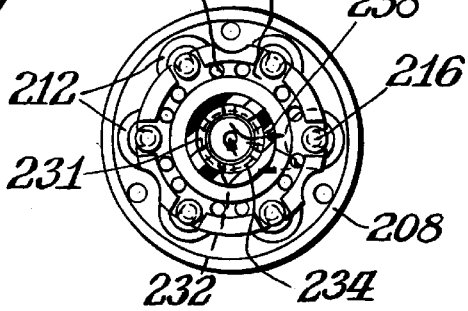
FIG. 13 a cross-sectional view top plan view of the shower head taken along line 13—13 of FIG. 12.
Figure 14:
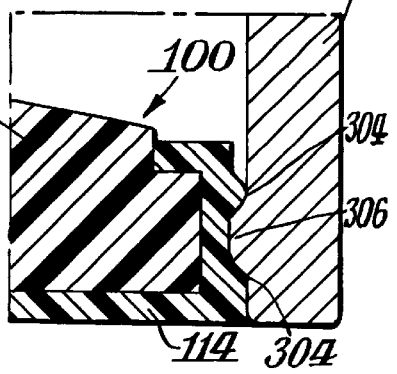
FIG. 14 is an enlarged cross-sectional view showing how the thermoplastic rubber coating engages and seals the face plate in the bell-shaped housing of the shower head of the present invention.

Another embodiment of the present invention, as shown in FIGS. 12 and 13, is generally drawn to a pulsating shower head 200 having a novel diverter valve. Shower head 200 has a bell-shaped housing 202 with a face plate 204 couple thereto. Face plate 204 comprises a hub portion 206 at its center and a body portion 208 extending away from hub portion 206. Hub portion 206 and body portion 208 are preferably made from the same materials as set forth above for the hub and body portions of face plate 100. Body portion 208 has a plurality of openings 210 provided therein for accommodating plungers 216 of the type shown in FIG. 3. Preferably, openings 210 have a thermoplastic rubber layer 212, most preferably made from Santoprene® rubber, provided on its walls. Thermoplastic rubber layer 212 has a ridge 214 extending away from and circumferentially around the walls of openings 210 in body portion 208. Face plate 204 of the present invention provides a close fit between plungers 216, plunger grooves, and openings 210 due to the slight compression of ridge 214 of thermoplastic rubber layer 212 around plungers 216.

Face plate hub portion 206 has a central opening 218 that receives a vibratory spray head 220 substantially similar to the vibratory spray head disclosed in U.S. Pat. No. 5,918,811, assigned to the assignee of the present invention, Speakman Company, and hereby incorporated by reference. A vibratory spray pattern is generated by the careful placement and orientation of plates 222, 224 of vibratory spray head 220 in central opening 218. Upper plate 222 contains holes 226 at the center and about the periphery thereof. Upper plate 222 also contains upstanding dams about its periphery that help guide water to holes 226. Lower plate 224 preferably contains a matching set of holes 228 of slightly larger diameter in the same configuration as upper plate 222. The ratio of hole diameter in lower plate 224 to hole diameter in upper plate 222 is preferably about 2:1, for example a 1/16 inch diameter hole in upper plate 222 and 1/8 inch diameter hole in lower plate 224. The number and orientation of holes in each plate can be varied but that number and orientation should be substantially the same in both the upper 222 and lower 224 plates.

To obtain a good vibratory spray, it is also desirable to have the mating patterns of holes in the upper and lower plates 222,224 vertically aligned when the plates are assembled in the faceplate as shown in FIG. 12. The best vibratory spray pattern is achieved when the holes in the upper plate 222 are aligned directly above the center of the larger holes in the lower plate 224. The quality of the vibratory spray pattern deteriorates in direct proportion to misalignment of the holes in the respective plates. When holes 226,228 in upper and lower plates 222, 224, respectively, start to misalign with each other, the vibrating spray pattern starts to deteriorate.

Another factor affecting the vibratory spray emanating from spray head 220 is the separation between the upper and lower plates 222,224. Using upper and lower holes 226, 228 of 1/16 and 1/8 inch diameter, respectively, a plate separation of about two tenths of an inch (0.200) is optimal, with a preferred range of about 0.150 to 0.300 inch and an operable range of 0.100 to 0.400 inch. If the holes in the upper and lower plates 222, 224 are enlarged, this plate separation could be increased. A general ratio of plate separation to the diameter of the hole in the lower plate of about 2:1 is preferred. It appears that the vibratory spray pattern is a function of the angle of expansion of the spray exiting each hole 226 in upper plate 222. This angle of expansion will determine the distance between the upper 222 and lower 224 plates.

Another feature of pulsating shower head 200 shown in FIGS. 12 and 13 is a diverter valve 230 having a cylindrical insert 231 communicating with cental opening 218 of face plate 204. Cylindrical insert 231 has a plurality of openings 232 provided in side portions thereof, and a deformable member 234 provided therein to cover openings 232. Preferably, deformable member 234 comprises the same Santoprene® rubber as set forth above. Diverter valve 230 couples to a spider 238, via a connector 236. Spider 238 holds plungers 216 in place in openings 210 in face plate 204 and connects to a handle 240 so that plungers 216 can be raised and lowered in openings 210. When spider 238 and plungers 216 are raised, the flow of water through face plate openings 210 is cut off. Water flow is diverted through openings 241 provided in a raceway 239 of spider 238. Consequently, water pressure against deformable member 234 increases and forces deformable member 234 inward and away from cylindrical insert openings 232, and allowing water to flow through central opening 218 of face plate 204. Thus, diverter valve 230 enables shower head 200 of this embodiment to generate a vibratory spray pattern by allowing water to flow into vibratory spray head 220.

In contrast to the complex mechanical designs of conventional diverter mechanisms, diverter valve 230 of the present invention is simple in design, and easy and inexpensive to manufacture and maintain.

Figure 9A:
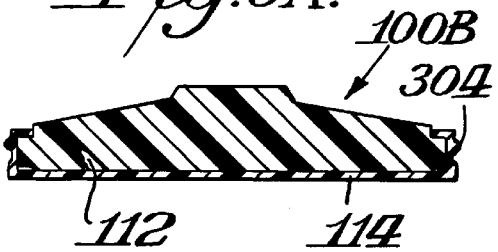

Reference numeral 100B of FIG. 9A shows another embodiment of the face plate of the present invention, wherein face plate 100B does not have a central opening 108 provided therein (like face plates 100 and 100A). The face plates of the present invention may be connected to the housing 202 of the shower head in a variety of ways. For example, face plate 100 (shown in FIGS. 5–10) and/or face plate 100A (shown in FIG. 11) may connect to housing 202 via a center screw provided through central opening 108. Alternatively, the rubber layer 114 of face plates 100, 100A, and/or 100B may have flanges 304 extending around the outer periphery of the face plates, and housing 202 may have a ridge 306 extending circumferentially around its inner portion. Face plates 100, 100A, 100B may be retained in housing 202 solely by the resilient snap-fit engagement between flanges 304 and ridge 306. The resilient snap-fit engagement eliminates the need for O-ring 16 (shown in the conventional shower head of FIG. 1), as well as the screws, and thus provides assembly advantages over conventional shower heads. Face plates 100, 100A may also be retained in housing 202 by both the center screw provided in central opening 108, and the resilient snap-fit engagement between flanges 304 and ridge 306.

Unlike face plates 100, 100A which may be attached to housing 202 via screws within central opening 108, face plate 204 may be coupled to housing 202 via screws provided through body portion 208 of face plate 204. Alternatively, face plate 204 may be retained in housing 202 solely by the resilient snap-fit engagement between flanges 304 and ridge 306. Finally, face plate 204 may be retained in housing 202 by both the screws provided through body portion 208, and the resilient snap-fit engagement between flanges 304 and ridge 306.

It will be apparent to those skilled in the art that various modifications and variations can be made in the shower head, face plate, plungers, and diverter valve of the present invention and in construction of these devices without departing from the scope or spirit of the invention. As an example, the plunger shape and design, including the shape and size of the plunger grooves, may be modified to obtain a variety of desirable water spray patterns. Further, like the face plate openings, the number and placement of the plungers of the present invention may vary. For example, the shower head may have two, three, four, six or eight plungers, depending upon the configuration of the face plate.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A face plate for a shower head having a hollow body with the face plate and a plurality of plungers at one end thereof, the hollow body connecting to a water source at its other end, the face plate comprising:

a plastic substrate with a plurality of openings, each plastic substrate opening receiving a corresponding plunger; and a thermoplastic rubber layer formed on portions of the plastic substrate, including walls of plastic substrate openings, wherein the thermoplastic rubber layer includes ridge portions extending away from and circumferentially around the plastic substrate openings, the ridge portions closely surrounding the plungers to form a close fit between the plungers and plastic substrate openings.

2. A face plate as recited in claim 1, wherein the thermoplastic rubber layer chemically bonds with the plastic substrate.

3. A face plate as recited in claim 2, wherein the thermoplastic rubber layer comprises Santoprene rubber.

4. A face plate as recited in claim 1, wherein the plastic substrate comprises polypropylene plastic.

5. A face plate as recited in claim 4, wherein the polypropylene plastic comprises from 15% to 20% glass-filled polypropylene plastic.

6. A face plate as recited in claim 1, wherein the ridge portions of the thermoplastic rubber layer clean the plurality of plungers.

7. A face plate as recited in claim 1, wherein the thermoplastic rubber layer has flanges extending around its outer periphery, the hollow body has a ridge extending circumferentially around its inner portion, and the face plate is retained in the hollow body by the resilient snap-fit engagement between the flanges of the thermoplastic rubber layer and the ridge of the hollow body.

8. A shower head comprising:

a hollow body connected at one end to a water source;

a face plate connected at the other end of the hollow body, the face plate including a plastic substrate having a plurality of openings formed therein and a thermoplastic rubber layer formed on portions of the plastic substrate, including walls of plastic substrate openings, wherein the thermoplastic rubber layer includes ridge portions extending away from and circumferentially around the plastic substrate openings; and a plurality of plungers, wherein each plastic substrate opening receives a corresponding plunger and the ridge portions closely surround the plungers to form a close fit between the plungers and plastic substrate openings.

9. A shower head as recited in claim 8, wherein the thermoplastic rubber layer chemically bonds with the plastic substrate.

10. A shower head as recited in claim 9, wherein the thermoplastic rubber layer comprises Santoprene rubber.

11. A shower head as recited in claim 8, wherein the plastic substrate comprises polypropylene plastic.

12. A shower head as recited in claim 11, wherein the polypropylene plastic comprises from 15% to 20% glass-filled polypropylene plastic.

13. A shower head as recited in claim 8, wherein the ridge portions of the thermoplastic rubber layer clean the plurality of plungers.

14. A shower head as recited in claim 8, wherein the thermoplastic rubber layer has flanges extending around its outer periphery, the hollow body has a ridge extending circumferentially around its inner portion, and the face plate is retained in the hollow body by the resilient snap-fit engagement between the flanges of the thermoplastic rubber layer and the ridge of the hollow body.

15. A diverter valve for a shower head having a hollow body with a face plate at one end thereof, a water source at the other end thereof, and plurality of plungers connected to a spider, the face plate having a plurality of circumferential openings provided therein and a central opening provided therein, wherein each face plate circumferential opening receives a corresponding plunger, the diverter valve comprising:

a cylindrical insert communicating with the cental opening of the face plate, the cylindrical insert having a plurality of openings formed therein and connecting to the spider; and a deformable member arranged on the inside of the cylindrical insert and covering the plurality of openings formed in the insert, wherein when water flowing through plungers is stopped, the water pressure against the deformable member increases and forces the deformable member away from the cylindrical insert openings, allowing water to flow through the central opening of the face plate.

16. A diverter valve as recited in claim 15, wherein the deformable member comprises Santoprene rubber sleeve.

17. A shower head comprising:

a hollow body connected at one end to a water source;

a face plate connected at the other end of the hollow body, the face plate having a plurality of circumferential openings provided therein and a central opening provided therein;

a plurality of plungers connected to a spider, each face plate circumferential opening receiving a corresponding plunger; and a diverter valve having a cylindrical insert communicating with the cental opening of the face plate, the cylindrical insert having a plurality of openings formed therein and connecting to the spider, the diverter valve further having a deformable member arranged on the inside of the cylindrical insert and covering the plurality of openings formed in the insert, wherein when water flowing through plungers is stopped, the water pressure against the deformable member increases and forces the deformable member away from the cylindrical insert openings, allowing water to flow through the central opening of the face plate.

18. A shower head as recited in claim 17, wherein the deformable member comprises Santoprene rubber sleeve.

19. A shower head comprising:

a hollow body connected at one end to a water source;

a face plate connected at the other end of the hollow body, the face plate including a plastic substrate having a plurality of circumferential openings formed therein and a central opening provided therein, the face plate further having a thermoplastic rubber layer formed on portions of the plastic substrate, including walls of the plastic substrate circumferential openings, wherein the thermoplastic rubber layer formed on the walls of the plastic substrate circumferential openings includes ridge portions extending away from and circumferentially around the plastic substrate circumferential openings;

a plurality of plungers connected to a spider, wherein each plastic substrate circumferential opening receives a corresponding plunger and the ridge portions closely surround the plungers to form a close fit between the plungers and plastic substrate circumferential openings; and a diverter valve having a cylindrical insert communicating with the cental opening of the face plate, the cylindrical insert having a plurality of openings formed therein and connecting to the spider, the diverter valve further having a deformable member arranged on the inside of the cylindrical insert and covering the plurality of openings formed in the insert, wherein when water flowing through plungers is stopped, the water pressure against the deformable member increases and forces the deformable member away from the cylindrical insert openings, allowing water to flow through the central opening of the face plate.

20. A shower head as recited in claim 19, wherein the thermoplastic rubber layer and the deformable member comprise Santoprene rubber sleeve.

21. A shower head as recited in claim 19, wherein the plastic substrate comprises polypropylene plastic.

22. A shower head as recited in claim 21, wherein the polypropylene plastic comprises from 15% to 20% glass-filled polypropylene plastic.

23. A shower head as recited in claim 19, wherein the ridge portions of the thermoplastic rubber layer clean the plurality of plungers.

24. A shower head as recited in claim 19, wherein the thermoplastic rubber layer has flanges extending around its outer periphery, the hollow body has a ridge extending circumferentially around its inner portion, and the face plate is retained in the hollow body by the resilient snap-fit engagement between the flanges of the thermoplastic rubber layer and the ridge of the hollow body.

25. A plunger for a shower head having a hollow body with a face plate at one end thereof with an opening therein, a water source at the other end thereof, the plunger being variably positioned in the face plate opening and comprising:

a generally cylindrical shaft portion having an upper end, means for attaching the shaft portion to a means for adjusting the plunger within the opening, and a lower end having a collar thereon whose diameter corresponds to that of the upper end; and a body portion having a plurality of semicircular grooves provided therein to permit water to pass through the opening in a controlled spray pattern, the plurality of semicircular grooves extending partially along the length of the body portion, the body portion further having a plurality of slots provided therein, each slot extending from a corresponding semicircular groove to a bottom of the body portion, wherein the slots permit water to pass through the opening in a needle-like spray pattern.

26. A shower head comprising:

a hollow body connected at one end to a water source;

a face plate connected at the other end of the hollow body, the face plate including a plastic substrate having a plurality of openings formed therein and a thermoplastic rubber layer formed on portions of the plastic substrate, including walls of plastic substrate openings, wherein the thermoplastic rubber layer formed on the walls of the plastic substrate openings includes ridge portions extending away from and circumferentially around the plastic substrate openings; and a plurality of plungers, wherein each plastic substrate opening receives a corresponding plunger and the ridge portions closely surround the plungers to form a close fit between the plungers and plastic substrate openings, each of the plurality of plungers having:

a generally cylindrical shaft portion having an upper end, means for attaching the shaft portion to a means for adjusting the plunger within the corresponding plastic substrate opening, and a lower end having a collar thereon whose diameter corresponds to that of the upper end, and a body portion having a plurality of semicircular grooves provided therein to permit water to pass through the corresponding plastic substrate opening in a controlled spray pattern, the plurality of semicircular grooves extending partially along the length of the body portion, the body portion further having a plurality of slots provided therein, each slot extending from a corresponding semicircular groove to a bottom of the body portion, wherein the slots permit water to pass through the corresponding plastic substrate opening in a needle-like spray pattern.

27. A shower head as recited in claim 26, wherein the ridge portions of the thermoplastic rubber layer clean the plurality of plungers.

28. A shower head as recited in claim 26, wherein the thermoplastic rubber layer has flanges extending around its outer periphery, the hollow body has a ridge extending circumferentially around its inner portion, and the face plate is retained in the hollow body by the resilient snap-fit engagement between the flanges of the thermoplastic rubber layer and the ridge of the hollow body.

* * * * *